US005642640A

United States Patent [19]

Insalaco et al.

[11] Patent Number: 5,642,640

[45] Date of Patent: Jul. 1, 1997

[54] BACK EXTRUSION PROCESS FOR FORMING A MANIFOLD PORT

[75] Inventors: Jeffrey Lee Insalaco, Brandon; William Marv Johnson, Pelshatchie; David Michael Halbig, Brandon, all of Miss.

[73] Assignee: Norsk Hydro A. S., Oslo, Norway

[21] Appl. No.: 571,721

[22] Filed: Dec. 13, 1995

[51] Int. Cl.[6] ..... B21D 28/28; B21J 5/12

[52] U.S. Cl. ..... 72/334; 72/357; 72/367; 29/890.08

[58] Field of Search ..... 72/357, 273.5, 72/367, 334, 327, 325; 29/890.08

[56] References Cited

U.S. PATENT DOCUMENTS

| | | | |
|---|---|---|---|
| 1,586,984 | 6/1926 | Foster . | |
| 2,221,934 | 11/1940 | Ferris | 287/54 |
| 2,310,083 | 2/1943 | Holmes | 72/325 |
| 2,530,855 | 11/1950 | Bugg et al. | 29/157.4 |
| 2,896,975 | 7/1959 | Wahl | 29/890.08 |
| 3,064,707 | 11/1962 | Walts | 153/2 |
| 3,108,362 | 10/1963 | Huet | 72/325 |
| 3,971,500 | 7/1976 | Kushner et al. | 228/154 |
| 4,026,456 | 5/1977 | Lema | 228/136 |
| 4,044,443 | 8/1977 | Cartet | 29/157.4 |
| 4,193,180 | 3/1980 | Press | 29/157.4 |
| 4,663,812 | 5/1987 | Clausen | 29/157.4 |
| 5,036,913 | 8/1991 | Murphy et al. | 165/173 |
| 5,127,154 | 7/1992 | Johnson et al. | 29/890.043 |
| 5,172,762 | 12/1992 | Shinmura et al. | 165/173 |
| 5,337,477 | 8/1994 | Waggoner | 29/890.052 |
| 5,419,174 | 5/1995 | Waggoner | 72/352 |

FOREIGN PATENT DOCUMENTS

| | | | |
|---|---|---|---|
| 19025 | 1/1984 | Japan | 72/367 |
| 88971 | 8/1958 | Netherlands | 72/357 |
| 12137 | of 1885 | United Kingdom | 72/327 |
| 2069386 | 8/1981 | United Kingdom | 72/325 |

OTHER PUBLICATIONS

"SAE Technical Paper Series", # 950570, Formcast Aluminum Components For Automotive Applications, John P. Waggoner, Amcast Industrial Corp., International Congress & Exposition, Detroit, MI, Feb. 27–Mar. 2, 1995.

*Primary Examiner*—Daniel C. Crane

*Attorney, Agent, or Firm*—Gary M. Hartman; Domenica N. S. Hartman

[57] ABSTRACT

A method for forming ports on a heat exchanger manifold, in which risers are back extruded in a single operation from the surrounding material of the manifold such that subsequent machining steps to further define and finish the port are unnecessary. The method of this invention generally includes forging the manifold between a pair of die halves so as to back extrude a localized portion of the manifold into a riser cavity in one of the die halves. Afterwards, and while the manifold remains within the die cavity, a punch is forced through the riser cavity and into the extruded portion in a direction toward the manifold so as to further back extrude the extruded portion. This step causes the raised portion to flow in a direction opposite to the direction of the punch, producing a riser having an internal bore defined by the punch and an outer surface defined by the cavity. An internal chamfer can be simultaneously formed on the internal bore of the riser in order to facilitate assembly of a tube with the riser. The precision of the punch operation yields risers that do not require further machining or finishing to correctly size the risers or form the chamfers.

20 Claims, 6 Drawing Sheets

BACK EXTRUSION PROCESS FOR FORMING A MANIFOLD PORT

BACKGROUND OF THE INVENTION

1. Field of the Invention

The present invention relates to heat exchangers, such as those of the type used in automobile air conditioning systems. More particularly, this invention relates to an improved extrusion process for forming ports on a heat exchanger manifold, in which risers are back extruded from the surrounding material of the manifold such that subsequent machining steps to further define and finish the port are unnecessary.

2. Description of the Prior Art

Heat exchangers are employed within the automotive industry as condensers and evaporators for use in air conditioning systems, radiators for cooling engine coolant, and heater cores for internal climate control. In order to efficiently maximize the amount of surface area available for transferring heat between the environment and a fluid flowing through the heat exchanger, the design of the heat exchanger is typically of a tube-and-fin type in which numerous tubes thermally communicate with high surface area fins. The fins enhance the ability of the heat exchanger to transfer heat from the fluid to the environment, or vice versa. For example, heat exchangers used in the automotive industry as air conditioner condensers serve to condense a vaporized refrigerant by transferring heat from the refrigerant to the air forced over the external surfaces of the condenser.

One type of heat exchanger used in the automotive industry is constructed of a number of parallel tubes which are joined to and between a pair of manifolds, creating a parallel flow arrangement. The manifolds form reservoirs that are in fluidic communication with the tubes through tube ports formed in the manifolds. One or both manifolds include one or more inlet and outlet ports through which a coolant enters and exits the heat exchanger. Conventionally, such heat exchangers have been constructed by soldering or brazing the tubes to their respective ports, which may be in the form of risers or openings defined in the walls of the manifolds. Finally, fins are provided in the form of panels having apertures through which the tubes are inserted, or in the form of centers that can be positioned between adjacent pairs of tubes.

The process by which the tube ports are formed has often entailed a significant number of processing steps in order to accurately shape the ports, such that minimal material is employed to achieve a sufficiently strong joint for the intended application. One type of tube port known in the prior art consists primarily of an opening in the manifold wall. While forming such openings generally involves a single punching operation, a drawback of this port configuration is the minimal amount of material available to engage and bond with the tube assembled with the port. This shortcoming is significantly exacerbated if a chamfer is added to the opening to facilitate assembly of a tube. A second type of tube port configuration employed in the prior art overcomes these shortcomings by including a riser or collar that provides a substantially greater amount of material for engagement with the tube. However, risers are more difficult to form than a simple opening in a manifold, and have conventionally entailed multiple forming operations. Accordingly, there is a desire to reduce the steps necessary to form this type of tube port. One such method is disclosed in U.S. Pat. No. 4,663,812 to Clausen, assigned to the assignee of this invention. Clausen teaches forming a longitudinal projection on a manifold, which is then further formed or machined to create solid risers that subsequently undergo a reverse impact extrusion process to form tubular risers. Though the teachings of Clausen provide a greatly simplified method for forming risers, further simplification of the process would be desirable. While processes are known by which a riser can be forged directly from a thick wall of a manifold while the manifold resides within a single die cavity, such methods have necessitated the use of dies whose mating male and female features are prone to excessive wear. One such method is taught by U.S. Pat. No. 5,337,477 to Waggoner, which discloses forging a riser on an oversized manifold by closing a pair of die halves on the manifold. One die half is configured as a punch to cause material flow into a cavity formed by the second die half, such that risers are simultaneously extruded and formed around cores positioned in channels in the second die half. Because the risers are formed entirely by the step of closing the die halves, the die half serving as the punch must project sufficiently into the cavity formed by the mating die half to ensure proper material flow as the dies are closed. The requirement for a closely mating punch and cavity and the resulting high loads that occur during die closure significantly promote wear of the mating die surfaces, and particularly wear of the edges of the punch as it enters the cavity and then engages the manifold. In addition, because the punch causes material throughout the cavity to flow toward the channels in the second die, side loading of the cores tends to occur, producing risers with nonuniform wall thicknesses.

From the above, it can be appreciated that further improvements would be desirable for processes employed to form tube ports on heat exchanger manifolds. In particular, such improvements would preferably minimize the number of processing steps necessary to form a tube port, yet must yield a port that promotes the joint strength of the tube-port assembly.

SUMMARY OF THE INVENTION

It is an object of this invention to provide a method for forming a tube port on a heat exchanger manifold, in which a minimal number of processing steps are required to produce a finished port.

It is another object of this invention that such a method promotes the joint strength between the port and a heat exchanger tube by promoting the amount of material available at the port to engage the tube.

It is a further object of this invention that such a method entails a forming operation within a closed die cavity, such that minimal loading occurs during closure of the die halves.

It is still another object of this invention that such a method entails a back extrusion operation that causes localized material flow at the surface from which the port is formed in a manner that promotes the dimensional uniformity of the port.

It is yet another object of this invention that such a method is carried out in a manner that reduces die wear.

In accordance with a preferred embodiment of this invention, these and other objects and advantages are accomplished as follows.

According to the present invention, there is provided a method for forming ports on a heat exchanger manifold, in which risers are back extruded from the surrounding material of the manifold such that subsequent machining steps to further define and finish the port are unnecessary. The invention is capable of producing an internal chamfer on each riser so as to facilitate the assembly of heat exchanger tubes with the ports while also promoting the strength of the tube-port joint.

The method of this invention generally includes providing a manifold having a passage formed therein, such that the passage defines a first wall at a first region of the manifold and a second wall at an oppositely-disposed second region of the manifold. The manifold is then positioned within a first die half whose cavity closely conforms to the second wall of the manifold. A second die half is then mated with the first so as to back extrude a portion of the first wall into a riser cavity in the second die half, thereby forming a raised portion on the manifold. Preferably, the cavity of the first die half sufficiently conforms to the second wall of the manifold to avoid material flow at the second wall, such that only localized material flow occurs at the first wall of the manifold. Afterwards, and while the manifold remains within the die cavity, a punch is forced through the riser cavity and into the raised portion in a direction toward the manifold so as to back extrude the raised portion. This step causes the raised portion to flow in a direction opposite to the direction of the punch, producing a riser having an internal bore defined by the punch and an outer surface defined by the cavity. In addition, an internal chamfer can be formed on the internal bore of the riser in order to facilitate assembly of a tube with the riser. The precision of the punch operation yields risers that do not require further machining or finishing to correctly size the risers or form the chamfers.

From the above, it can be seen that the method of this invention provides a simplified process for forming tube ports on a heat exchanger manifold. In particular, a minimal number of processing steps are required to produce a finished port, with all basic forming steps occurring at one forging station within a single die cavity. The finished port is formed to include a riser that increases the amount of material available to engage and bond to a heat exchanger tube, thereby promoting the joint strength between the port and the tube. Importantly, the primary operation during which the port is formed occurs while the die is closed, which eliminates the prior art requirement of using one of the die halves as a punch to form the port. As such, minimal loading occurs during closure of the die halves and the dies can be configured to be less susceptible to wear. Furthermore, the die halves and punch are preferably configured to cause only localized material flow at the surface from which the riser is formed in a manner that promotes the dimensional uniformity and consistency of the port.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
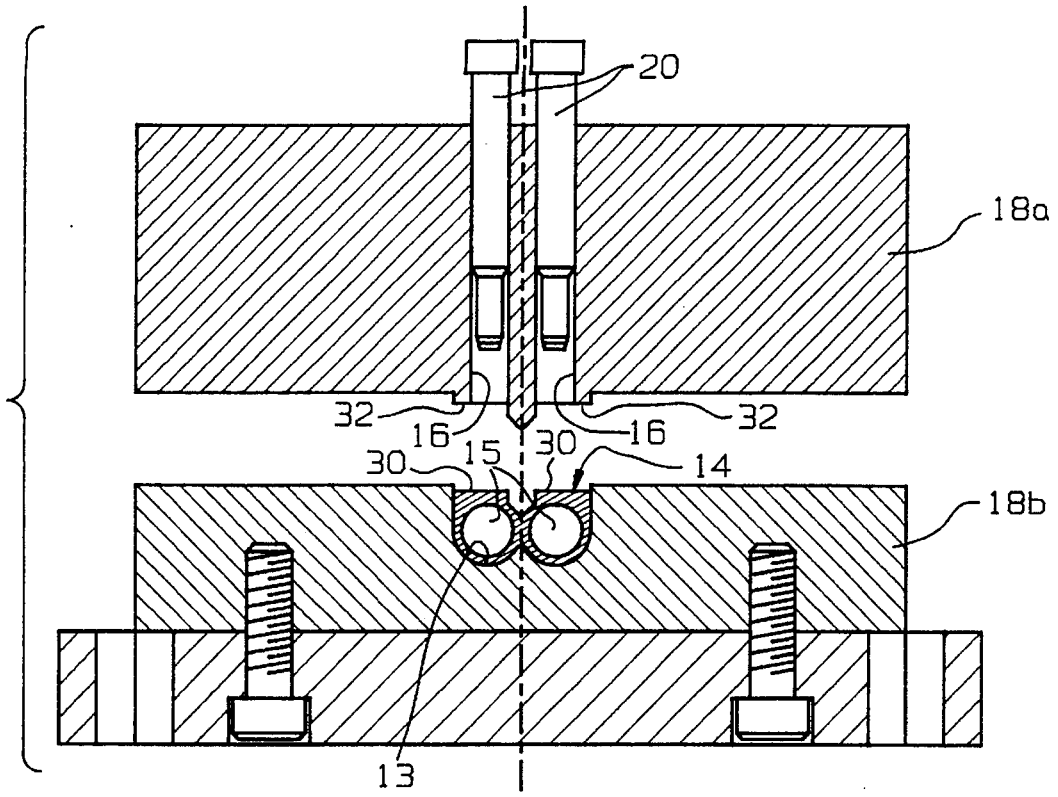
FIGS. 1, 2A, 2B, 3, 4, 5 and 6 illustrate the processing steps entailed in forming a heat exchanger tube port on a manifold in accordance with a first embodiment of this invention.

Represented in FIGS. 1 through 6 is a method in accordance with a first embodiment of this invention for forming tube ports 12 (FIGS. 3 through 6) on a heat exchanger manifold 14. While only two ports 12 are illustrated in the cross-sectional views of FIGS. 1 through 6, any number of ports 12 can be simultaneously formed along the length of the manifold 14 in accordance with the method of this invention, as is suggested by the cross-sectional view of FIG. 2B. As is apparent from these Figures, the ports 12 are each configured to include a riser 24 that is back extruded in a two-step operation from the surrounding material of the manifold 14, such that subsequent machining steps to further define and finish the ports 12 are unnecessary. As shown, the manifold 14 shown is generally of the type which includes a pair of passages 15 through which a refrigerant flows when being routed between tubes (not shown) of the heat exchanger. The manifold 14 is preferably formed from a suitable aluminum alloy, though other alloys could be used, and the scope of this invention is not to be limited to any particular alloy. Furthermore, while the manifold 14 illustrated in FIGS. 1 through 6 is particularly suited for practicing this invention, numerous variations on the configuration shown are foreseeable, as will be apparent from the embodiment of this invention illustrated in FIGS. 7 through 10.

FIG. 1 represents a first processing step, in which the manifold 14 has been positioned in a lower die half **18*b* whose cavity 13 closely conforms to the lower face and both sides of the manifold 14. Preferably, the cavity 13 in the lower die half 18*b* sufficiently conforms to the lower face and sides of the manifold 14 in order to avoid material flow in this region of the manifold 14, such that localized material flow can only occur at the exposed upper face 30 of the manifold 14. The upper face 30 of the manifold 14 is shown as being planar so as to form a stable deformable surface and provide a greater wall thickness than at the oppositely disposed lower face of the manifold 14. The greater wall thickness at the upper face 30 provides the material from which the risers 24 will be subsequently formed. Also shown in FIG. 1 is the mating upper die half 18*a*, in which a pair of punches 20 are shown as being received in a corresponding pair of bores 16. The punches 20 can be actuated by any suitable means capable of selectively actuating the punches 20 with a sufficient force to deform the upper face 30 of the manifold 14. A downwardly-extending planar rim 32 is present on the lower surface of the upper die half 18*a*, and is sized to be received within the cavity 13 formed by the lower die half 18*b*. The rim 32 surrounds each pair of bores 16, and is sized to extend only slightly into the cavity 13, as shown in FIG. 2A**.

Figure 2A:
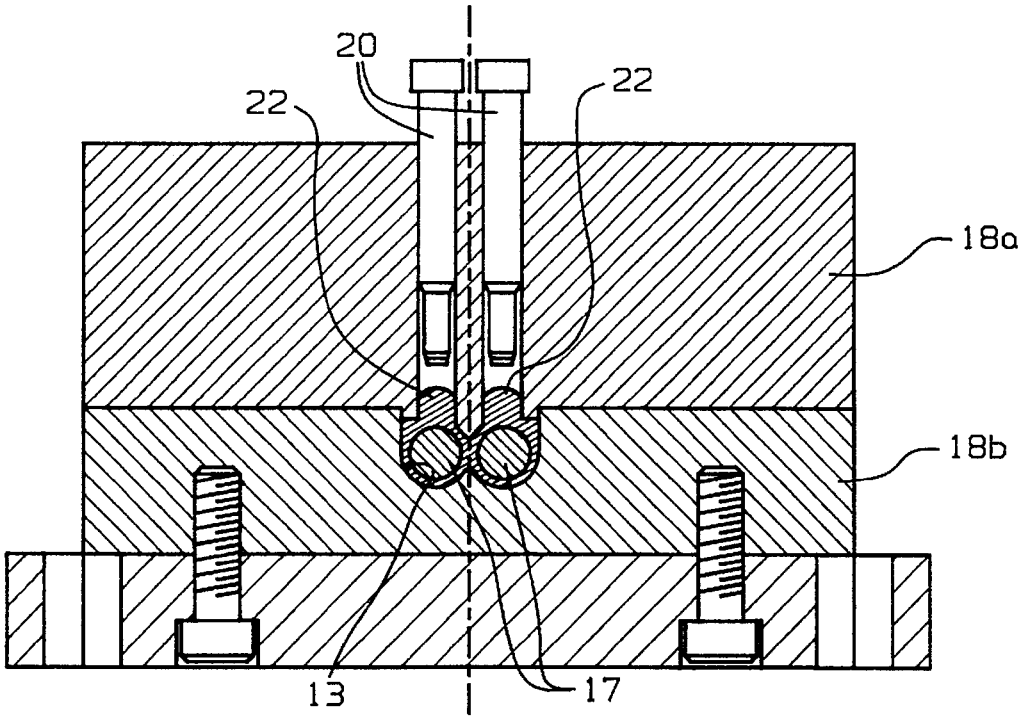
Figure 2B:
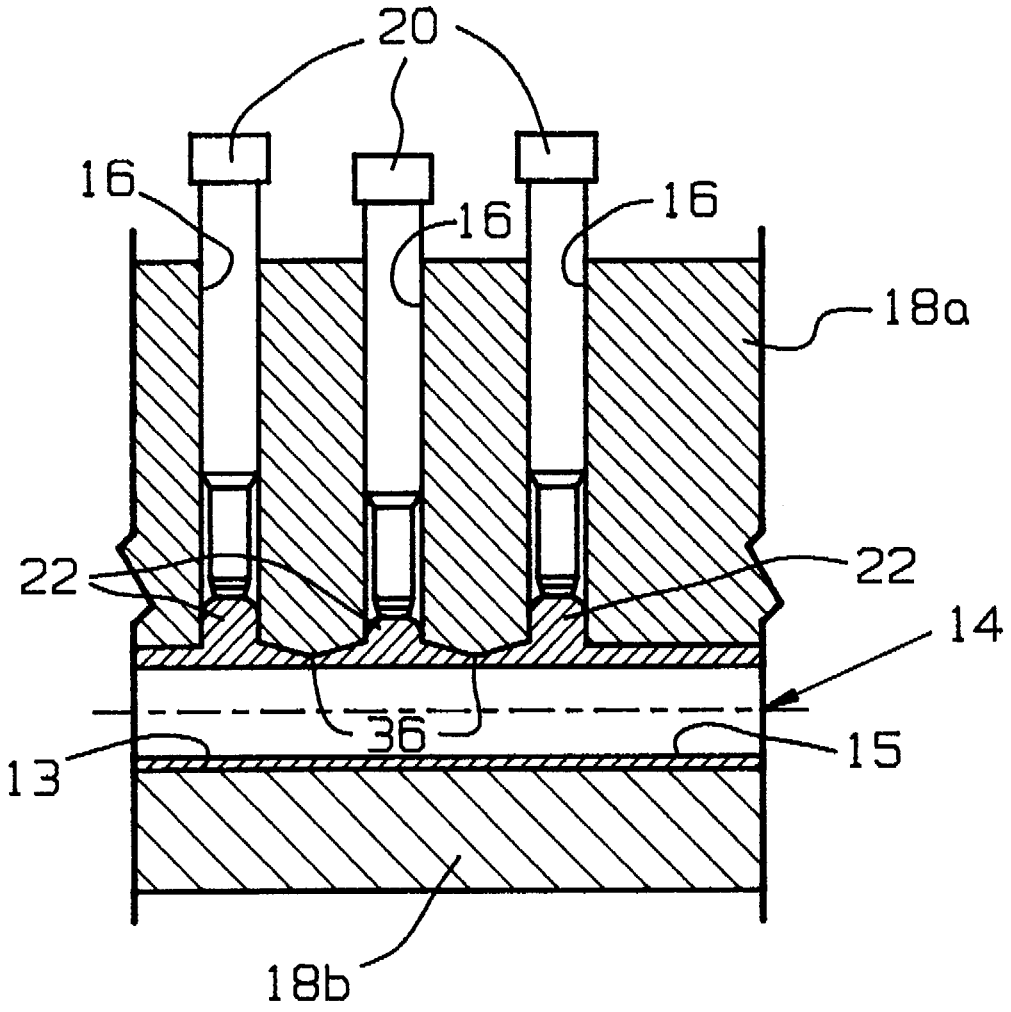

FIGS. 2A and 2B represent a second step in the port forming process, in which the upper die half **18*a* has been mated with the lower die half 18*b* so as to back extrude portions 22 of the manifold's upper face 30 into the bores 16 in the upper die half 18*a*. For this step, a mandrel 17 is positioned in each passage 15 in order to prevent the passages 15 from deforming or collapsing. The rim 32 and the cavity 13 of the upper and lower die halves 18*a* and 18*b*, respectively, are formed such that material from only the planar upper face 30 of the manifold 14 flows unimpeded into the bores 16. As shown in FIG. 2A, the rim 32 is accommodated within the die cavity 13 formed by the lower die half 18*b*, and engages the upper face 30 of the manifold 14 so as to back extrude a central region of the upper face 30 into the bores 16 in the upper die half 18*a*. As shown in FIG. 2B, the upper die half 18*a* further includes projections 36 between adjacent pairs of bores 16, which encourage metal flow into the bores 16 from the upper face 30 of the manifold 14. In combination with the rim 32**, the projections 36 enable the upper die half 18*a* to gather material locally from the upper face 30, and extrude this material into the bores 16 with minimal effect on material elsewhere in the manifold 14. In contrast, the lower die half 18*b* serves essentially as containment for the remainder of the manifold 14 during the extrusion operation.

Closure of the die halves 18*a* and 18*b* does not form the risers 24, but only the extruded portions 22. As such, the punches 20 are not deflected during extrusion. Furthermore, the lower die half 18*b* merely serves as a stationary platform on which the back extrusion process is performed, thereby significantly simplifying the back extrusion apparatus and process. In particular, the mating surfaces of the upper and lower die halves 18*a* and 18*b* do not require prominent male surface features capable of causing material flow throughout the cavity 13, and are therefore much less prone to wear during closure of the die and extrusion of the portions 22. Wear of the mating surfaces of the die halves 18*a* and 18*b* is further minimized because the upper face 30 of the manifold 14 is planar before the extrusion of the portions 22 and remains planar in the regions surrounding the risers 24, such that the rim 32 primarily serves as a barrier to material flow and is not required to particularly deform the manifold 14.

Figure 3:
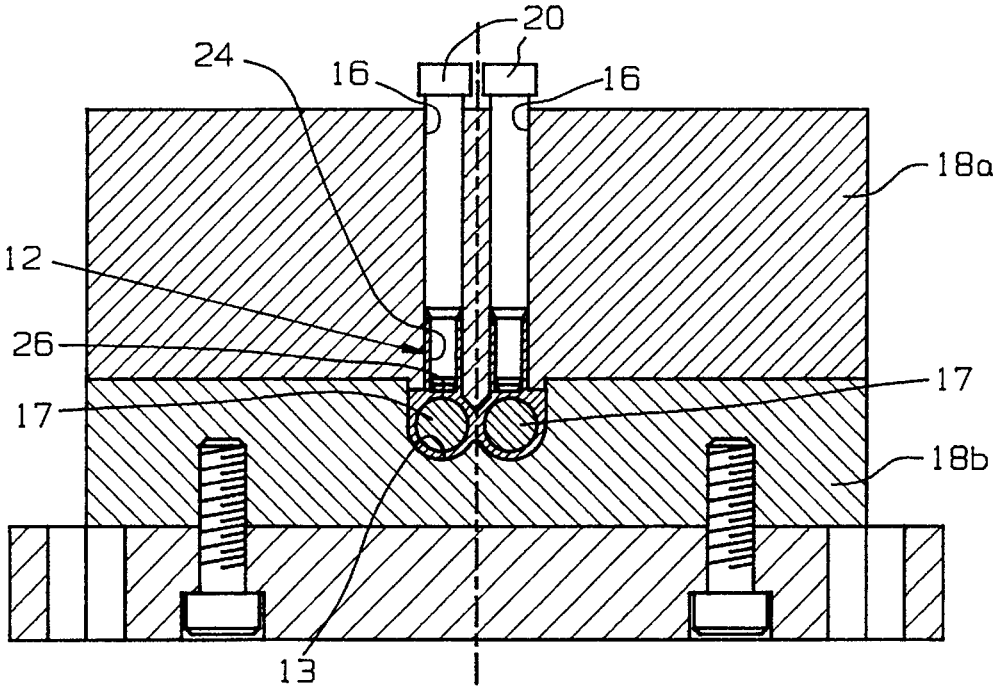

FIG. 3 illustrates the next step, in which the punches 20 are actuated downwardly through their respective bores 16 and into the extruded portions 22, thereby further back extruding the portions 22 to form tubular-shaped risers 24, while leaving a thin wall 26 at the bottom of each resulting riser 24. This operation is performed while the die halves 18*a* and 18*b* remain closed under high pressure. As is apparent from FIG. 3, the extruded portions 22 flow in a direction opposite to the direction of the punches 20, such that internal bores within the risers 24 are defined by the punches 20 and the outer surfaces of the risers 24 are defined by the bores 16. The precision of this punching operation yields risers 24 that do not require further machining or finishing, but are correctly sized and shaped to mate with the tubes intended for assembly with the manifold 14. Precision and adaptability of the process have been found to be particularly promoted as a result of using moving punches 20, as opposed to the stationary cores taught by the prior art, and the ability to readily adjust the distance that the punches 20 travel in order to alter the height of the riser 24.

Figure 4:
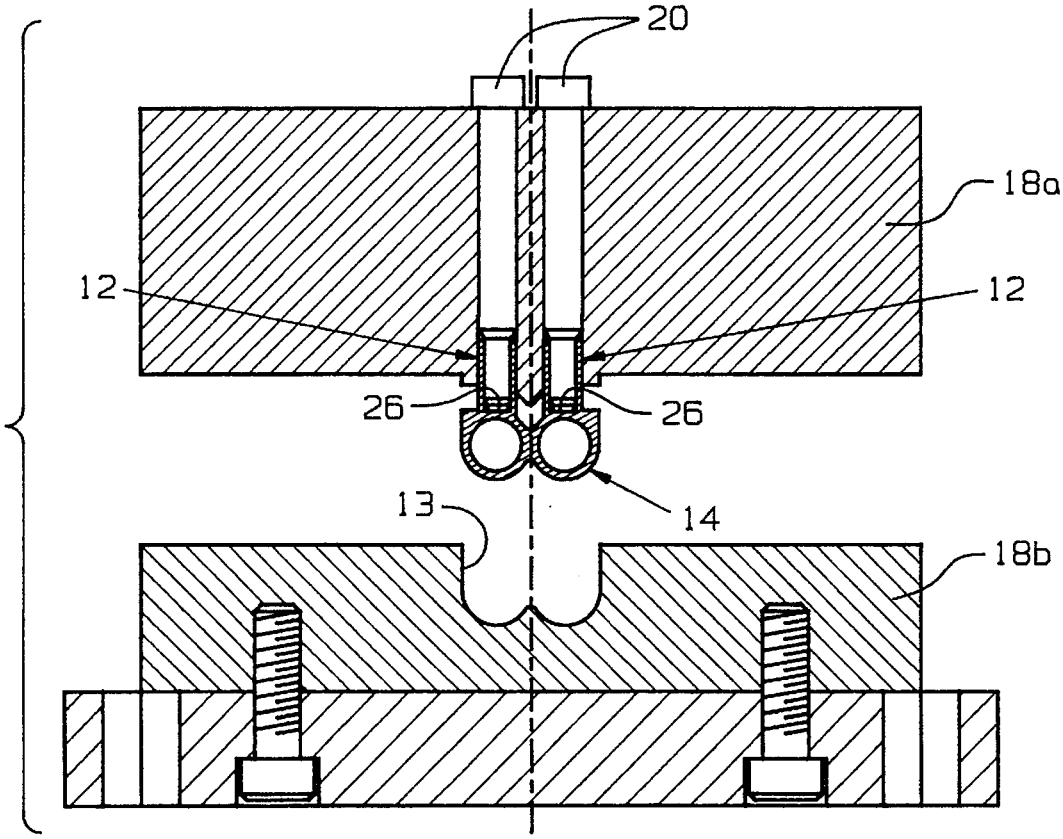
Figure 5:
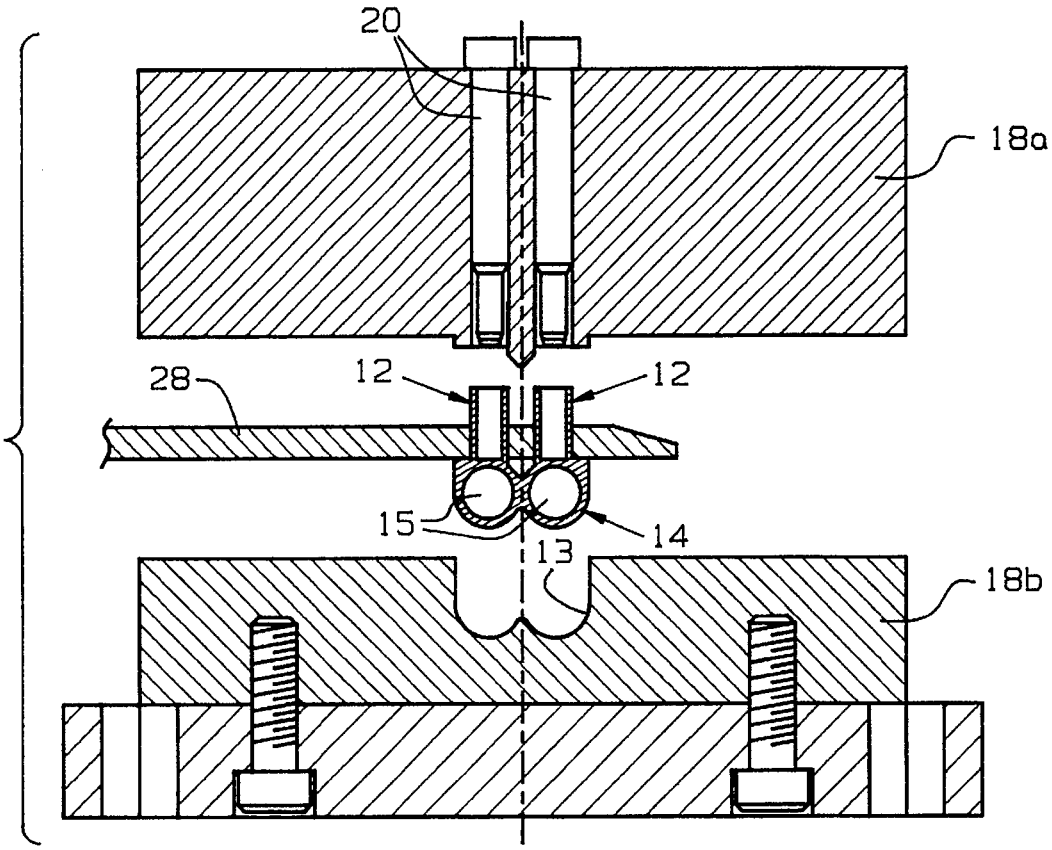
Figure 6:
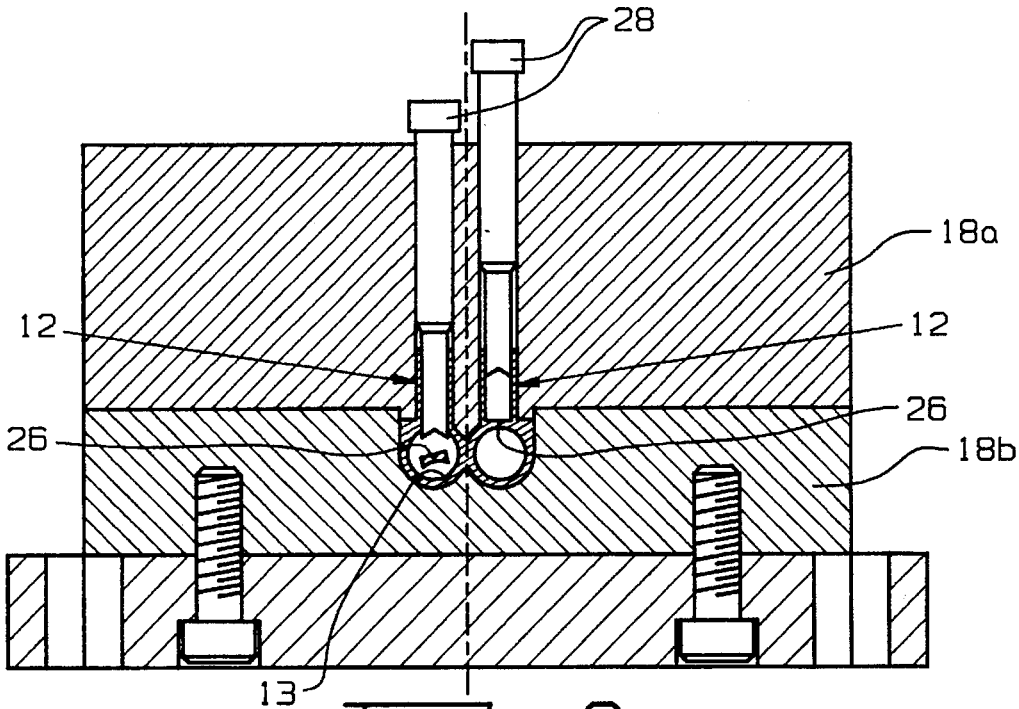
Figure 7:
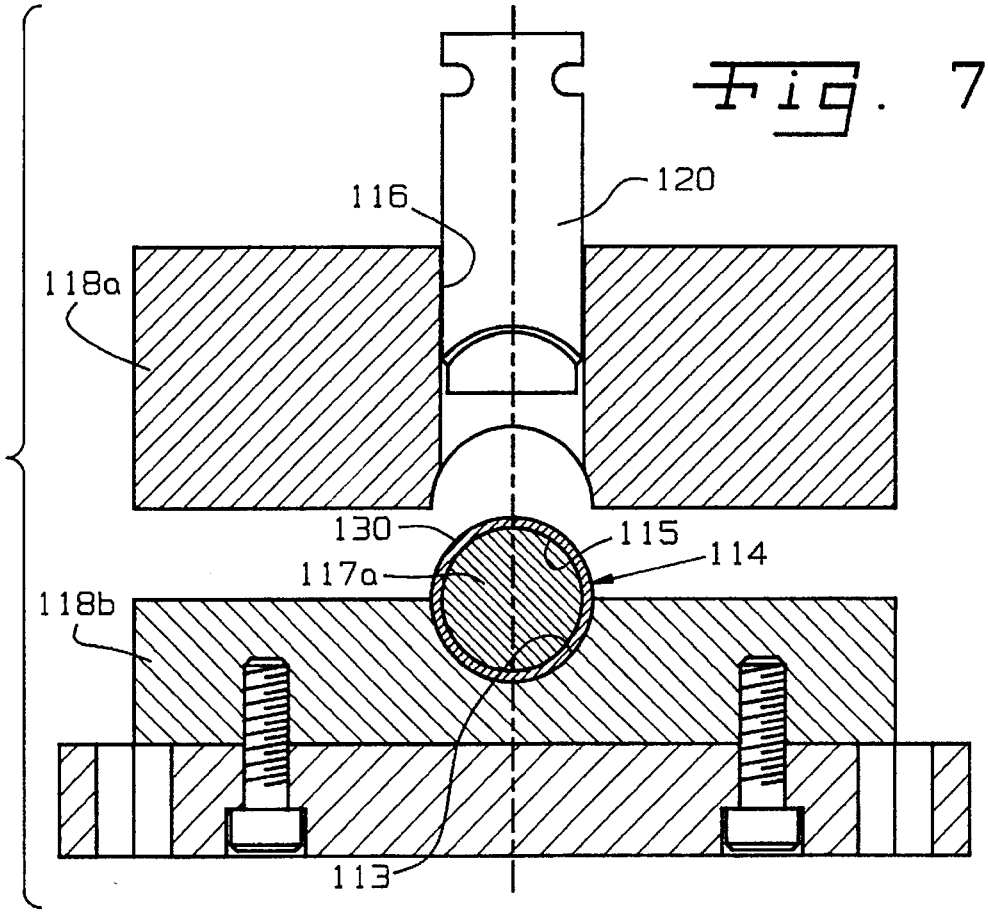
FIGS. 7 through 10 illustrate the processing steps entailed in forming a heat exchanger tube port on a manifold in accordance with a second embodiment of this invention.

Next, the punches 20 are retracted and the die halves 18*a* and 18*b* separated as shown in FIG. 4, with the manifold 14 remaining engaged with the punches 20. Afterwards, a stripper tool 32 is inserted between the manifold 14 and the upper die half 18*a*, and the manifold 14 is stripped from the punches 20 as shown in FIG. 5. FIG. 6 illustrates a final processing step in which the thin walls 26 between the risers 24 and the manifold 14 are pierced with piercing tools 28. This step can be carded out using the same lower die half 18*b* mated with a different upper die half 18*c* equipped with the piercing tools 28. For this operation, the mandrels 17 are removed from the passages 15 as shown to permit the piercing tools 28 to completely pierce the walls 26 from the manifold 14.

From the above, it can be seen that the above method provides a simple yet durable process for forming a tube port 12 on a heat exchanger manifold 14. In particular, a minimal number of processing steps are required to produce a finished port 12, with all basic forming steps occurring at one forging station within a single die cavity 13. The finished port 12 is formed to include a riser 24 that increases the amount of material available to engage and bond to a heat exchanger tube subsequently assembled with the manifold 14, thereby promoting the joint strength between the port 12 and the tube. Importantly, the primary operation during which the port 12 is formed occurs while the die is closed, such that minimal loading occurs during closure of the die halves 18*a* and 18*b*, allowing the use of dies whose configurations have reduced susceptibility to wear. In addition, the back extrusion operation causes only localized material flow at the face 30 from which the riser 24 is formed, such that dimensional uniformity of the port 12 is promoted.

FIGS. 7 through 10 represent a second embodiment of this invention, in which a chamfer 136 is formed on a back extruded riser 124 to facilitate assembly of a tube with a heat exchanger manifold 114. The back extrusion process is generally the same as that of the first embodiment, but is illustrated with a manifold 114 that differs in appearance from the manifold 14 shown in FIGS. 1 through 6. As with the first embodiment, the first step of this embodiment is to position the manifold 114 in a lower die half 118*b* whose cavity 113 closely conforms to the lower half of the manifold 114. Preferably, the cavity 113 sufficiently conforms to the lower half of the manifold 114 to avoid material flow in this region of the manifold 114, such that localized material flow can only occur at the exposed upper half 130 of the manifold 114. The upper half 130 of the manifold 114 preferably has a greater wall thickness than at the lower half of the manifold 114 in order to provide additional material from which the riser 124 will be subsequently formed. A mandrel 117*a* is positioned in a passage 115 formed in the manifold 114 in order to prevent the passage 115 from deforming or collapsing during subsequent processing during which the riser 124 is formed from the upper half 130 of the manifold 114. Also shown is the mating upper die half 118*a* in which a punch 120 is shown as being received in a bore 116.

Figure 8:
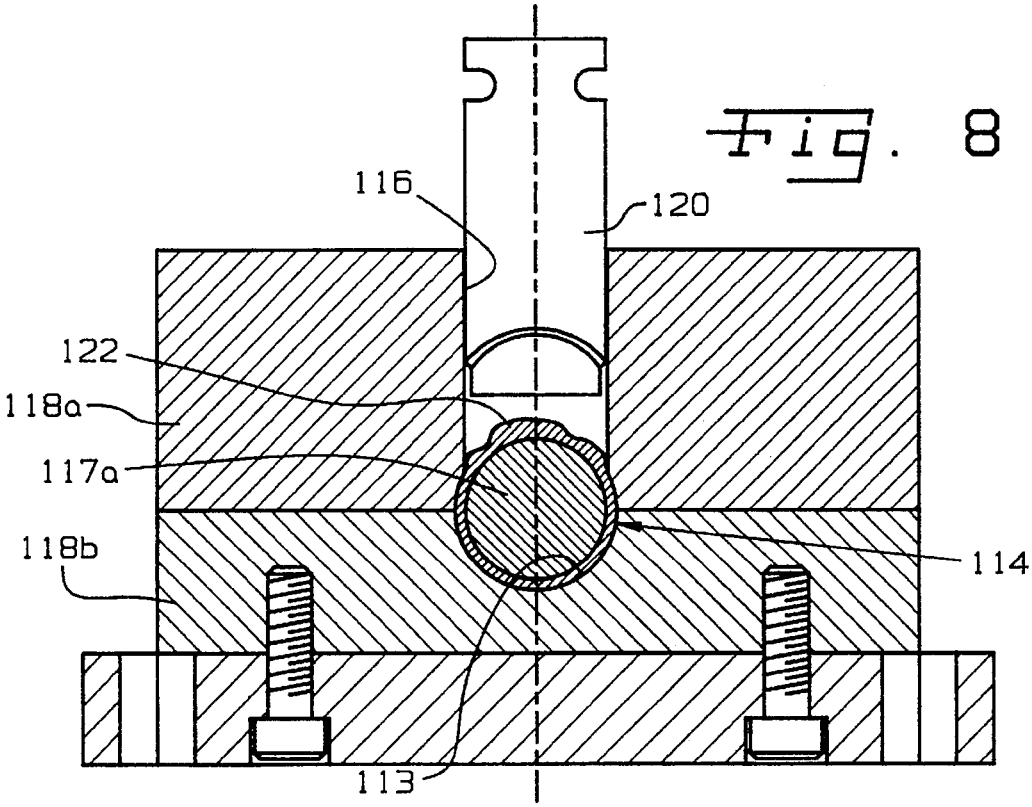

FIG. 8 represents a second step in the back extrusion process, in which the upper die half 118*a* has been mated with the lower die half 118*b* so as to back extrude a raised portion 122 into the bore 116 in the upper die half 118*a*. The upper and lower die halves 118*a* and 118*b* are formed such that the material from only the upper half 130 of the manifold 114 flows unimpeded into the bore 116. As with the first embodiment, closure of the die halves 118*a* and 118*b* does not form the riser 124, but only the raised portion 122, such that neither of the die halves 118*a* and 118*b* are required to have a prominent surface feature that serves as a punch to deform the manifold 114 to the extent required by the prior art. Notably, a male surface feature, such as the rim 32 of the first embodiment, is completely absent from the mating surfaces of the die halves 118*a* and 118*b*, thereby completely eliminating edges and comers that would otherwise be susceptible to wear.

Figure 9:
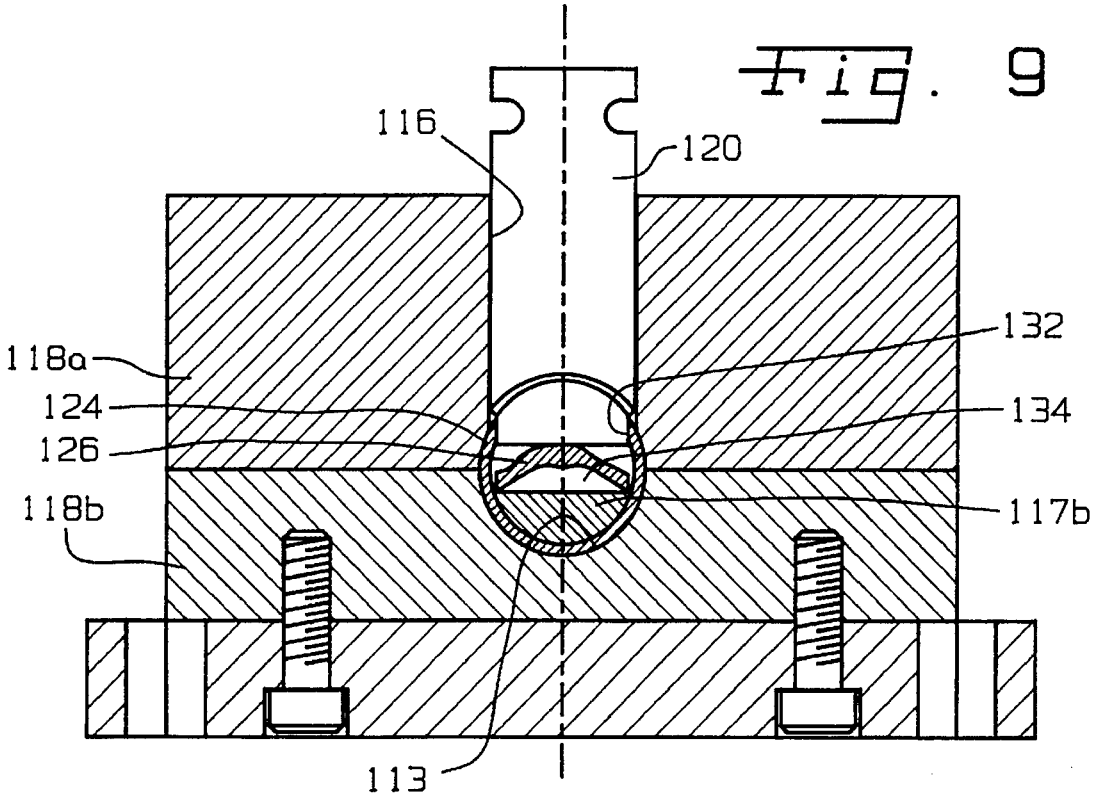
Figure 10:
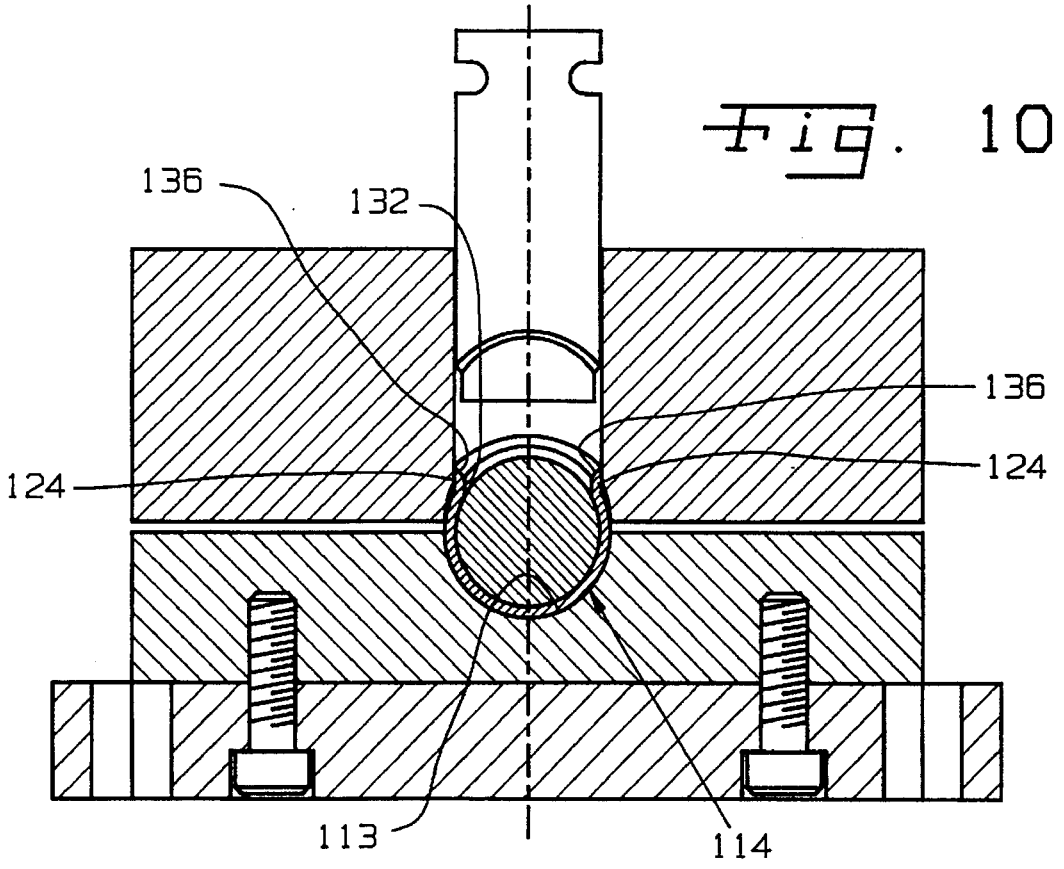

FIGS. 9 and 10 illustrate the next steps of this process, in which the punch 120 is actuated downwardly through the bore 116 and into the raised portion 122, so as to back extrude a peripheral region of the raised portion 122 to form the riser 124 while simultaneously removing the remaining central region 126 of the manifold wall within the riser 124 to form a port opening 132. This operation may be performed with a different mandrel 117*b* than that used when the raised portion 122 was formed (FIG. 8), such that a recess 134 is present beneath each raised portion 122 on the mandrel 114 in order to accommodate the end of the punch 120. Alternatively, the original mandrel 117*a* could be used, but indexed longitudinally to align a recess 134 formed therein with the raised portion 122. The punch 120 is then retracted and the die halves 118*a* and 118*b* separated (not shown) to allow the manifold 114 to be removed from the die halves 118*a* and 118*b* .

As is apparent from FIG. 10, the riser 124 is much smaller than the riser 24 of FIGS. 1 through 6, so as to have the appearance of a collar surrounding the port opening 132 in the manifold 114. Furthermore, the riser 124 is formed to have an internal chamfer 136 that facilitates assembly of a tube into the opening 132 formed by the riser 124. Importantly, the chamfer 136 is formed only on the riser 124, and therefore above the opening 132 whose interior surface is required to engage the exterior surface of a heat exchanger tube that is inserted into the opening 132 during assembly of the heat exchanger. As such, the presence of the chamfer 136 on the manifold 114 does not reduce the radial wall thickness of the manifold 114 in the region immediately circumscribing the riser 124. Consequently, the chamfer 136 does not weaken the manifold-tube joint yet promotes the ease with which the manifold 114 is assembled with its tubes.

The geometries of the chamfer 136 and the port opening 132 are defined by the punch 120, while the exterior of the riser 124 is defined by the bore 116 in the upper die half 118*a*. As with the embodiment illustrated in FIGS. 1 through 6, the precision of the punching operation represented in FIGS. 7 through 10 is such that the riser 124 and chamfer 136 do not require further machining or finishing, but are correctly sized and shaped to mate with a tube with which the manifold 114 is assembled. As depicted in FIG. 10, the riser 124 has a wall thickness of less than the original wall thickness of the manifold 114, though it is foreseeable that a riser 124 having a wall thickness greater than the original wall thickness of the manifold 114 could be produced. In addition, the riser 114 is shown as projecting above the exterior surface of the manifold 114 a distance not more than the wall thickness of the manifold 114. As such, minimal material must be back extruded to form the riser 124, yet the above-noted advantages of the riser 124 are still achieved.

From the above, it can be seen that the back extrusion process of the second embodiment of this invention provides the same basic advantages described for the first embodiment. Namely, the port is formed to include a riser 124 that increases the amount of material available to engage and bond to a heat exchanger tube, thereby promoting the joint strength between the manifold 114 and the tube, and all basic forming steps occur within a single die cavity 113, with minimal loading occurring during closure of the die halves 118*a* and 118*b* in order to allow the use of dies whose configurations have reduced susceptibility to wear.

While our invention has been described in terms of a preferred embodiment, it is apparent that other forms could be adopted by one skilled in the art. For example, the processing steps could be modified, and materials and manifold configurations other than those noted above could be adopted in order to yield a heat exchanger suitable for a wide variety of applications. Accordingly, the scope of our invention is to be limited only by the following claims.

The embodiments of the invention in which an exclusive property or privilege is claimed are defined as follows:

1. A method for forming a manifold port, the method comprising the steps of:

providing a manifold having a passage formed therein, the passage defining a first wall at a first region of the manifold and a second wall at an oppositely-disposed second region of the manifold;

positioning the manifold within a die cavity in a first die half, the die cavity conforming to the second wall of the manifold;

mating a second die half with the first die half so as to back extrude a portion of the first wall into a cavity defined exclusively within the second die half, the portion of the first wall forming a raised portion on the manifold; then forcing a punch through the cavity in the second die half and into the raised portion in a direction toward the manifold so as to back extrude the raised portion, the punch causing the raised portion to flow in a direction opposite to the direction of the punch so as to form a riser having an internal bore defined by the punch and an outer surface defined by the cavity in the second die half, and removing the manifold from the second die half.

2. A method as recited in claim 1 wherein the first wall has a greater thickness than the second wall.

3. A method as recited in claim 1 wherein the first die half conforms to the second wall of the manifold such that the mating and forcing steps do not cause material flow at the second wall.

4. A method as recited in claim 1 wherein the forcing step produces a third wall between the bore in the riser and the passage in the manifold, the method further comprising the step of piercing the third wall to form an aperture between the bore and the passage.

5. A method as recited in claim 1 wherein the first wall defines a planar external surface region on the manifold.

6. A method as recited in claim 1 wherein the second die half comprises a planar surface that is accommodated within the die cavity during the mating step, the planar surface engaging the first wall of the manifold during the mating step so as to back extrude a central region of the first wall into the cavity in the second die half.

7. A method as recited in claim 1 wherein the second die half causes a portion of the first wall of the manifold between adjacent pairs of cavities to be back extruded into the cavities in the second die half.

8. A method as recited in claim 1 wherein the forcing step produces an internal chamfer on the riser.

9. A method for forming a back extruded port on a heat exchanger manifold, the method comprising the steps of:

providing a manifold having two passages formed therein, each of the passages having a first wall defining a planar external surface on a first side of the manifold and a second wall defining an arcuate external surface of the manifold;

positioning the manifold within a die cavity in a first die half, the die cavity conforming to the arcuate external surface of the manifold;

mating a second die half with the first die half so as to back extrude a portion of each of the first walls into corresponding cavities in the second die half, the portions of the first walls forming stubs on the manifold; then forcing punches through each of the cavities and into the stubs in a direction toward the manifold so as to back extrude the stubs, the punches causing the stubs to flow in a direction opposite to the direction of the punches, wherein each of the stubs forms a riser having a bore defined by a corresponding one of the punches and an outer surface defined by a corresponding one of the cavities;

separating the first and second die halves; and removing the manifold from the second die half.

10. A method as recited in claim 9 wherein the first walls have greater thicknesses than the second walls.

11. A method as recited in claim 9 wherein the first die half conforms to the second walls of the manifold such that the mating and forcing steps cause localized material flow at the first walls and not at the second walls.

12. A method as recited in claim 9 wherein the forcing step produces a third wall between each of the bores and a corresponding one of the passages in the manifold, the method further comprising the step of piercing each of the third walls to form apertures between the bores and the passages.

13. A method as recited in claim 9 wherein the second die half comprises a planar surface that is accommodated within the die cavity during the mating step, the planar surface engaging the planar external surfaces of the manifold during the mating step so as to back extrude a central region of each planar external surface into the cavities in the second die half.

14. A method as recited in claim 9 wherein the second die half causes a portion of the planar external surfaces of the manifold between adjacent pairs of cavities to be back extruded into the cavities in the second die half.

15. A method as recited in claim 9 wherein the forcing step produces an internal chamfer on each of the risers.

16. A method for forming a back extruded chamfered port on a heat exchanger manifold, the method comprising the steps of:

providing a manifold having a passage formed therein, the passage defining a first wall at a first region of the manifold and a second wall at an oppositely-disposed second region of the manifold, the first wall having a greater wall thickness than the second wall;

positioning the manifold within a die cavity in a first die half, the die cavity conforming to the second wall of the manifold;

mating a second die half with the first die half so as to back extrude a portion of the first wall into a cavity in the second die half, the portion of the first wall forming a raised portion on the manifold; then forcing a punch through the cavity in the second die half and into the raised portion in a direction toward the manifold so as to back extrude the raised portion, the punch causing the raised portion to flow in a direction opposite to the direction of the punch so as to form a riser having a bore defined by the punch and an outer surface defined by the cavity in the second die half, the punch further forming an internal chamfer limited to the riser so as not to reduce the wall thickness of the first wall in a region circumscribing the riser.

17. A method as recited in claim 16 wherein the die cavity conforms to the second wall of the manifold such that the mating and forcing steps cause localized material flow at the first wall and not at the second wall.

18. A method as recited in claim 16 wherein the forcing step simultaneously produces an aperture between the passage in the manifold and the bore in the riser.

19. A method as recited in claim 16 wherein the forcing step causes the riser to have a wall thickness which is less than the wall thickness of the first wall.

20. A method as recited in claim 16 wherein the forcing step causes the riser to project from the first wall a distance not more than the wall thickness of the first wall.

* * * * *